US012533545B2

(12) United States Patent
Casagrande et al.

(10) Patent No.: US 12,533,545 B2
(45) Date of Patent: Jan. 27, 2026

(54) SYSTEM FOR MONITORING A GYMNASTIC DEVICE AND OPERATION METHOD THEREOF

(71) Applicant: TECHNOGYM S.P.A., Cesena FC (IT)

(72) Inventors: Simone Casagrande, Cesena FC (IT); Claudia Patella, Cesena FC (IT); Fabio Pozzi, Cesena FC (IT)

(73) Assignee: TECHNOGYM S.P.A., Cesena FC (IT)

( * ) Notice: Subject to any disclaimer, the term of this patent is extended or adjusted under 35 U.S.C. 154(b) by 200 days.

(21) Appl. No.: 18/307,658

(22) Filed: Apr. 26, 2023

(65) Prior Publication Data

US 2023/0347200 A1 Nov. 2, 2023

(30) Foreign Application Priority Data

Apr. 27, 2022 (IT) ..... 102022000008222

(51) Int. Cl.
*A63B 21/075* (2006.01)

(52) U.S. Cl.
CPC ..... *A63B 21/075* (2013.01); *A63B 2220/52* (2013.01); *A63B 2220/833* (2013.01)

(58) Field of Classification Search
None
See application file for complete search history.

(56) References Cited

U.S. PATENT DOCUMENTS 10,065,064 B2 9/2018 Smith et al.
10,695,614 B2 6/2020 Owusu
(Continued)

FOREIGN PATENT DOCUMENTS

CN 114028764 A * 2/2022 ..... A63B 21/075
CN 114245754 A * 3/2022 ..... A63B 21/075

OTHER PUBLICATIONS

Extended European Search Report dated Sep. 15, 2023 for European Patent Application No. 23169027.2-1122, 8 pages.
(Continued)

*Primary Examiner* — Shila Jalalzadeh Abyaneh
(74) *Attorney, Agent, or Firm* — KNOBBE, MARTENS, OLSON & BEAR, LLP

(57) ABSTRACT

The present disclosure relates to a system for monitoring the adjustment of the weight of a dumbbell, that can be used by a user for carrying out a gymnastic exercise, comprising: a dumbbell, provided with a hollow handle, having an axial development along an axis, capable of rotating clockwise and counterclockwise around said axis, and provided with a first end, a second end and comprising in its cavity a first locking member and a second locking member, a first plurality of weights, wherein each weight can be locked individually at said first end, by means of said first locking member or said second locking member, when said handle rotates in a way, and can be unlocked from said first end, when said handle rotates in the opposite way, a second plurality of weights, wherein each weight can be locked individually at said second end, by means of said first locking member or said second locking member, when said handle rotates in a way, and can be unlocked from said second end, when said handle rotates in the opposite way, wherein said system comprises at least one detecting device comprising in turn at least one magnet placed on said first locking member and/or said second locking member, at least one sensor, capable of detecting the magnetic field generated by said at least one magnet, in that said at least one detecting device is capable to send data corresponding to said detected magnetic field, and in that it comprises a logic control unit capable of receiving said data sent by said at least one detecting device and by associating to said data a weight of said first and second plurality of weights.

12 Claims, 6 Drawing Sheets

(56) References Cited

U.S. PATENT DOCUMENTS

| | | | | |
|---|---|---|---|---|
| 2010/0323856 | A1* | 12/2010 | Svenberg | A63B 21/075 482/108 |
| 2013/0288859 | A1 | 10/2013 | Watterson | |
| 2016/0184623 | A1* | 6/2016 | Moran | A63B 21/075 482/8 |
| 2017/0001061 | A1* | 1/2017 | Marjama | A63B 71/0036 |
| 2022/0054891 | A1 | 2/2022 | Owusu | |
| 2022/0096890 | A1* | 3/2022 | Lu | A63B 21/0728 |

OTHER PUBLICATIONS

Communication pursuant to Article 94(3) EPC dated Mar. 27, 2025 for European Patent Application No. 23169027.2-1122, 4 pages.
Search Report dated Dec. 7, 2022, for Italian Application No. 102022000008222, 10 pages.

* cited by examiner

SYSTEM FOR MONITORING A GYMNASTIC DEVICE AND OPERATION METHOD THEREOF

CROSS-REFERENCE TO RELATED APPLICATIONS

This application claims priority to Italian Patent Application No. 102022000008222, filed on Apr. 27, 2022, which is incorporated herein by reference in its entirety.

TECHNICAL FIELD

The present disclosure relates to a system for monitoring a gymnastic device, in particular the monitoring of the weight adjustment of a dumbbell for the execution of a gymnastic exercise.

The present disclosure also relates to the operating method of the monitoring system of a gymnastic device.

More in detail, the disclosure relates to a system, designed and realized in particular to monitor the adjustment of the amount of weight loaded on a dumbbell for performing a strength gymnastic exercise, but which can be used for any gymnastic exercise which the use of a dumbbell.

In the following, the description will be directed to a dumbbell comprising a system for monitoring the adjustment of the weight selected from a plurality of weights that can be selected on the basis of the strength gymnastic exercise to be performed, but it is evident that the same should not be considered limited to this specific job.

BACKGROUND

As is well known, strength training systems are currently employed to develop strength and improve the muscular endurance of a user.

Activities typically associated with strength training involve the use of resistance, often in the form of weights, to increase muscle recruitment and help increase maximal strength.

Workouts may therefore require the use of free weights, such as barbells and dumbbells, in which a user controls the movement or position of these weights for a period of time or for a number of sets and repetitions.

When performing exercises with free weights, a user may perform movements unrestrained by supportive equipment, and thus a user often performs such movements in an equipment-free environment, such as a home environment.

Usually, both dumbbells and barbells include a rod or handle at the ends, of which one or more weights are fixed, usually circularly shaped, based on the resistance necessary to perform the exercise.

Often, placing weights on the rod is an operation that requires the user to stop exercising for an extended period, necessary for loading or unloading the weights.

Therefore, compact weight loading systems have become widespread, mainly used for dumbbells, in which, by means of an actuation device, it is possible to select the weight from a plurality of weights already arranged near the rod, thus reducing loading times and unloading by the user.

In these types of dumbbells, the user must know the weight loaded on the dumbbell in order to perform the exercise exactly.

Weight measurement devices are currently known which measure the weight loaded on the dumbbell during weight selection.

However, these devices often prove to be unreliable in accurately detecting the weight.

SUMMARY

In light of the above, it is, therefore, an object of the present disclosure to provide a system for monitoring the weight adjustment of a dumbbell that is reliable and simple to implement.

Another object of the disclosure is to provide a system, which allows the acquisition and memorization of the weight measurement carried out.

A further object is to provide a reliable method of operation of the detection system.

It is therefore specific object of the present disclosure a system for monitoring the adjustment of the weight of a dumbbell, that can be used by a user for carrying out a gymnastic exercise, comprising a dumbbell, provided with a hollow handle, having an axial development along an axis, capable of rotating clockwise and counterclockwise around said axis, and provided with a first end, a second end and comprising in its cavity a first locking member and a second locking member, a first plurality of weights, wherein each weight can be locked individually at said first end, by means of said first locking member or said second locking member, when said handle rotates in a way, and can be unlocked from said first end, when said handle rotates in the opposite way, a second plurality of weights, wherein each weight can be locked individually at said second end, by means of said first locking member or said second locking member, when said handle rotates in a way, and can be unlocked from said second end, when said handle rotates in the opposite way, said system comprising at least one detecting device comprising in turn at least one magnet placed on said first locking member and/or said second locking member, at least one sensor, capable of detecting the magnetic field generated by said at least one magnet, at least one detecting device capable to send data corresponding to said detected magnetic field, and a logic control unit capable of receiving said data sent by said at least one detecting device and by associating to said data a weight of said first and second plurality of weights.

Further according to the disclosure, said detecting device comprises two magnets.

Preferably according to the disclosure, said detecting device comprises three magnets.

Still according to the disclosure, said detecting device comprises four magnets.

Always according to the disclosure, said detecting device comprises a plurality of magnets.

Further according to the disclosure, said at least one sensor is arranged in said first end and/or in said second end of said handle.

Preferably according to the disclosure, said system comprises a supporting frame, to support said dumbbell, and said at least one detecting device is arranged on said supporting frame.

Still according to the disclosure, said system comprises a communication module, capable of receiving said data and/or said processed data and to send them to remote devices or cloud units.

Always according to the disclosure, said system comprises a memory unit in which predefined magnetic field calibration data associated with the weight of said first and second plurality of weights are stored.

It is further object of the present disclosure an operating method of a system for monitoring the regulation of the weight of a dumbbell, of the type comprising a hollow handle capable of rotating in a way, to lock one or more weights of said first and second plurality of weights, or in the opposite way to unlock one or more weights from said handle, can be unlocked from said first end, in said hollow handle being arranged a first locking member and a second locking member and at least one magnet placed on said first locking member and/or on said second locking member, capable of generating a magnetic field, comprising the following steps:

a. detecting said magnetic field and associating corresponding data;
b. sending said data obtained in said step a. to a logic control unit;
c. associating, by means of said logic control unit, said data to the selected or released weight of said first (P1) and second (P2) plurality of weights;
d. sending said associated weight in said step c. to remote devices and/or cloud units.

Further according to the disclosure, said method comprises following calibration steps:

e. storing a predetermined association between the data of said magnetic field and a weight of said first and second plurality of weights;
f. repeating step e. for all the weights of said first and second plurality of weights.

Preferably according to the disclosure, said steps e. and f. are carried out before said step c.

BRIEF DESCRIPTION OF THE DRAWINGS

The present disclosure will be now described, for illustrative but not limitative purposes, according to its preferred embodiments, with particular reference to the figures of the enclosed drawings, wherein:

In the various figures, similar parts will be indicated with the same reference numbers.

With reference to FIG. 1, the system S for monitoring the weight adjustment of a dumbbell, object of the present disclosure, essentially comprises a support frame 1, a dumbbell 2 housed on said support frame 1, a first plurality of weights P1, and a second plurality of weights P2, which can be coupled to said dumbbell 2.

Figure 1:
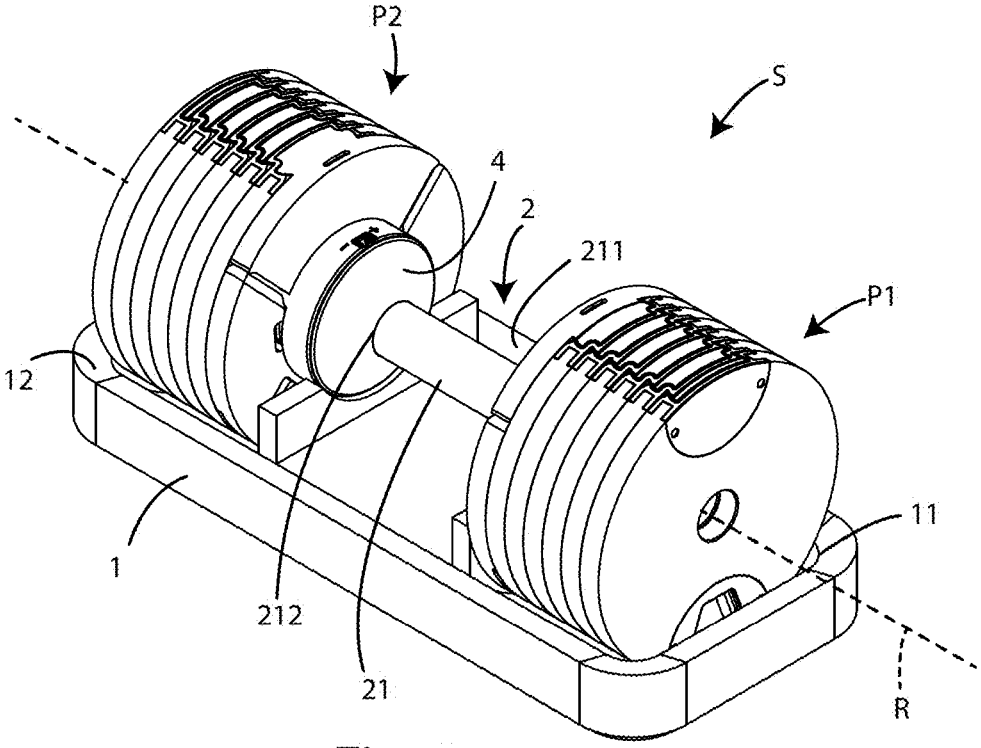
FIG. 1 shows a perspective view of the monitoring system of a gymnastic tool, object of the present disclosure.

Said support frame 1 comprises a first housing 11 and a second housing 12.

Said dumbbell 2 comprises a handle 21 which extends axially according to an axis R, around which said handle 21 is able to rotate clockwise and counterclockwise.

Said handle 21 is a hollow cylindrical elongated body, which develops along said axis R.

Figure 3:
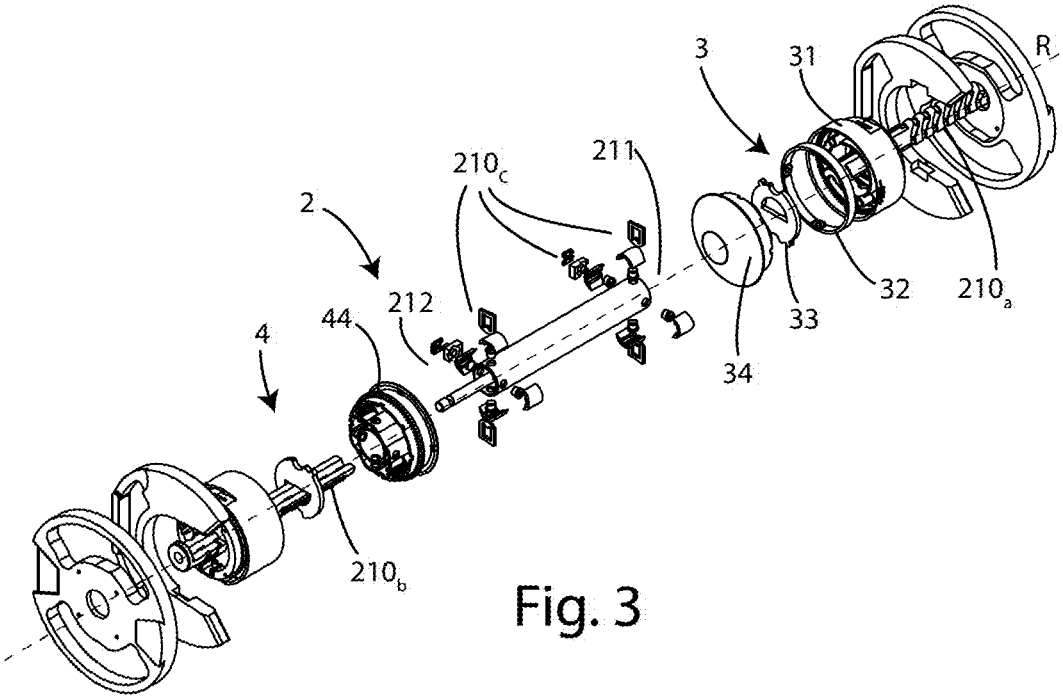
FIG. 3 shows a further exploded view of a further part of the system shown in FIG. 1.
Figure 4:
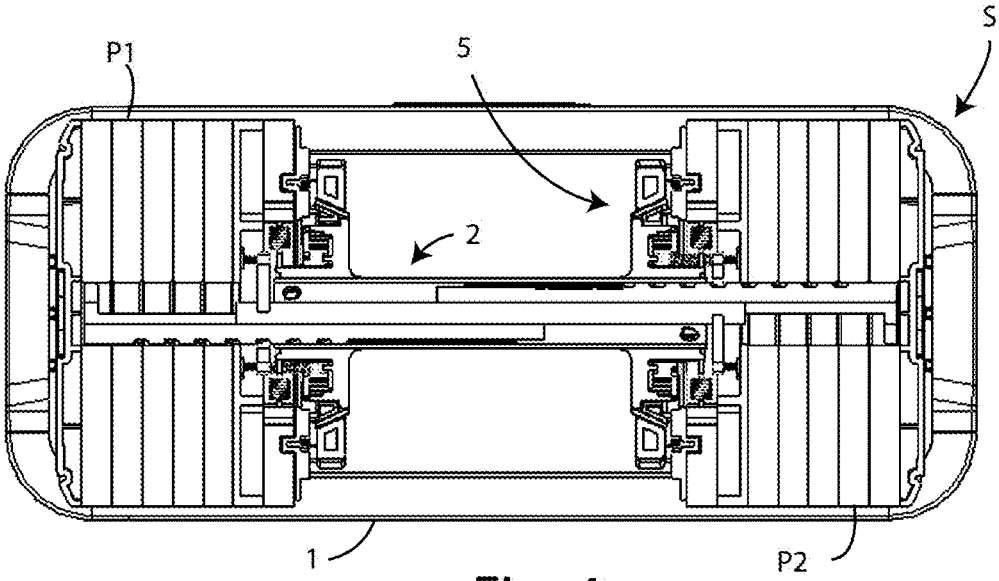
FIG. 4 shows a top view of a section of a dumbbell included in the system, in an open position.
Figure 5:
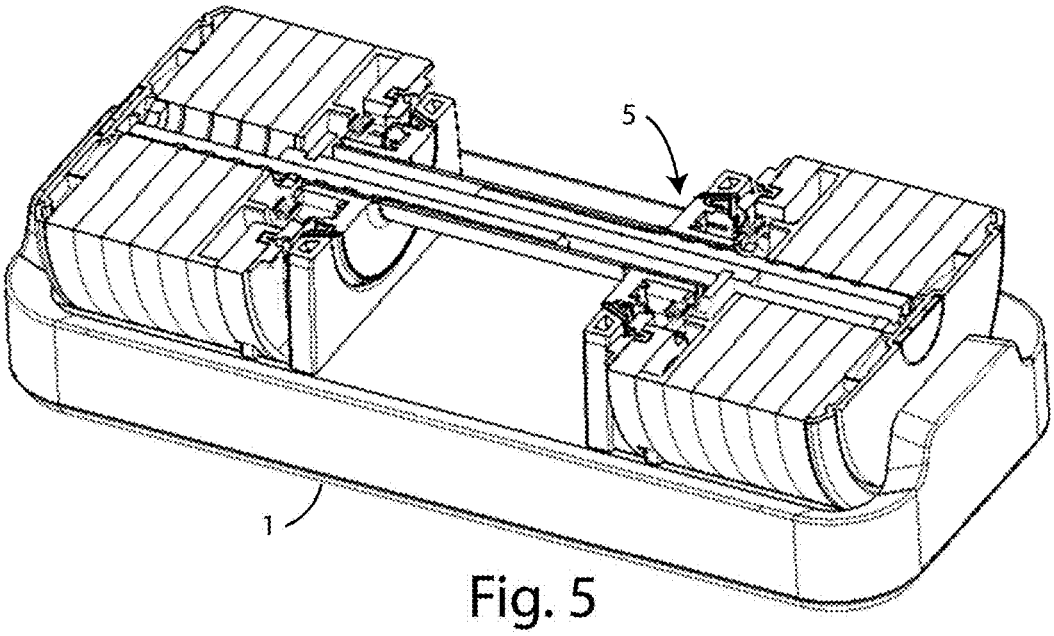
FIG. 5 shows a perspective view of the dumbbell of FIG. 4.
Figure 6:
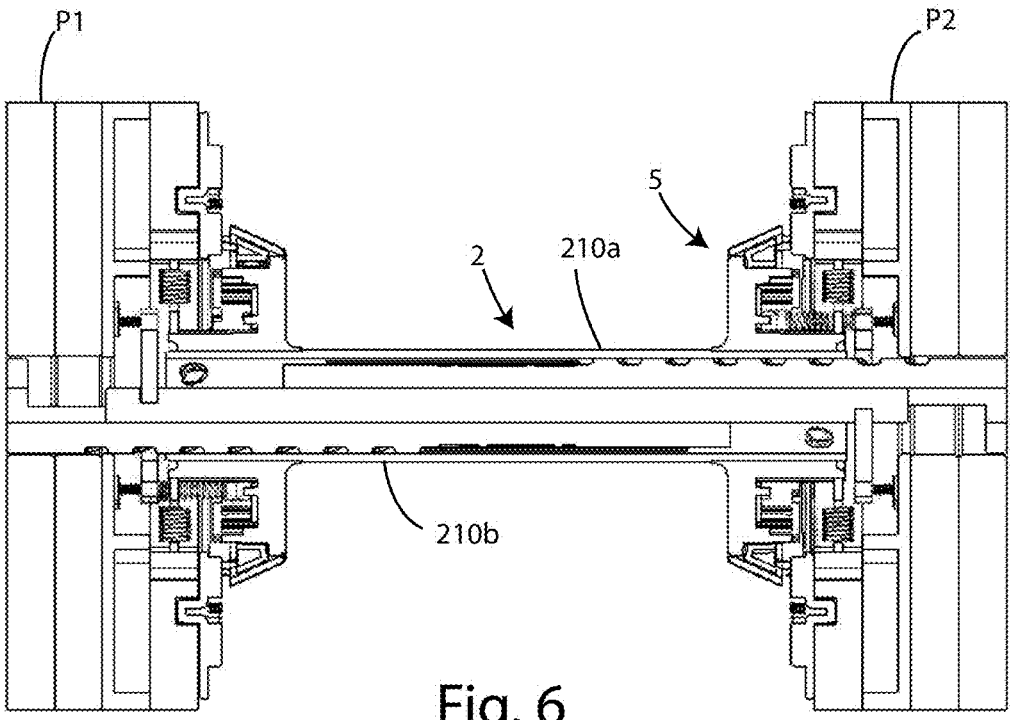
FIG. 6 shows a top view of a section of a dumbbell included in the system, in an intermediate open position.
Figure 7:
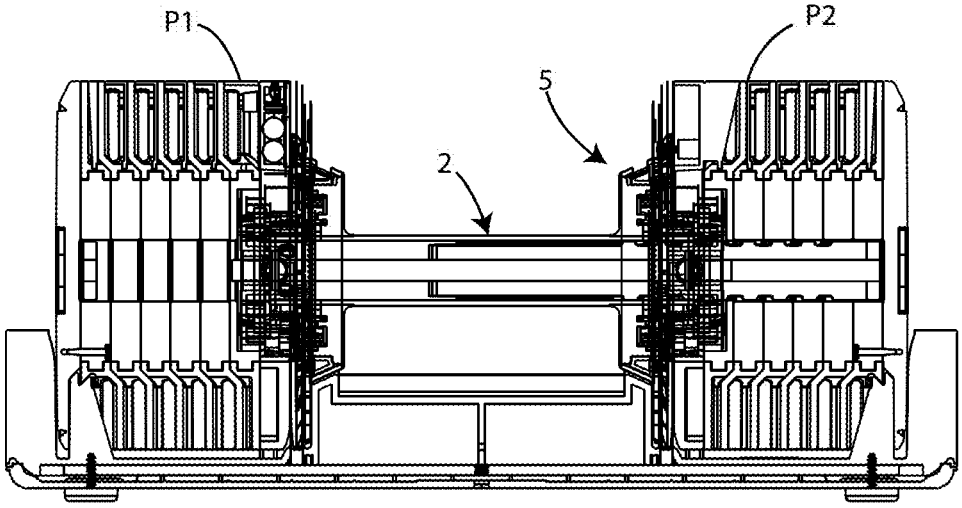
FIG. 7 shows a top view of a section of a dumbbell included in the system, in a closed position.
Figure 8:
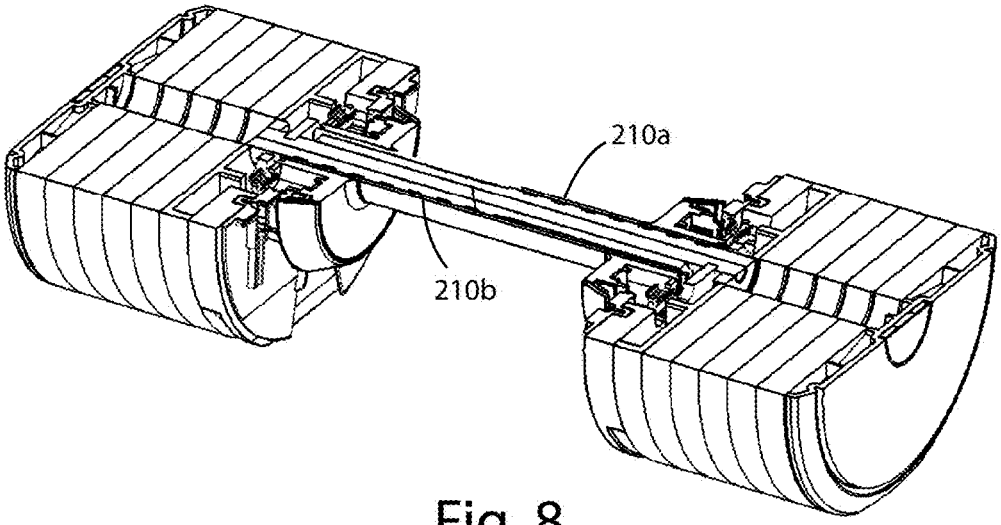
FIG. 8 shows a perspective view of the dumbbell of FIG. 7.

With reference to FIG. 3, a first selector element 210*a* and a second selector element 210*b* are housed inside the handle 21, on the surfaces of which helical grooves are formed.

The rotation of the handle 21 causes a progressive translation along the axis R of said first 210*a* and second 210*b* selector element. This allows at least one weight to be selected both from said first P1 and from said second P2 plurality of weights.

Said first 210*a* and second 210*b* selector element are movably coupled to said first handle 21 by means of a plurality of pins 210*c*, integral with said first handle 21.

Said first 210*a* and second 210*b* selector element are capable of passing from a closed position, in which they are completely contained inside said first handle 21 and facing each other, towards a plurality of open positions, in which they move away from each other on the other by translating along said R axis, moving according to opposite directions of said R axis.

The rotation of the handle 21 and of the plurality of pins 210*c* integral with it causes the progressive axial displacement of said first 210*a* and second 210*b* selector element.

The plurality of pins 210*c* engages in the helical grooves of said first 210*a* and second 210*b* selector element, causing their axial movement along the axis R.

Said handle 21 has a first end 211 and a second end 212.

Said first plurality of weights P1 is associated with the first end 211, while said second plurality of weights P2 is associated with the second end 212.

Each weight of said first P1 and second P2 plurality of weights is shaped so as to ensure a shape fitting with the contiguous weights.

When said dumbbell 2 is rested on said support frame 1, said first plurality of weights P1 is arranged in said first housing 11, while said second plurality of weights P2 is arranged in said second housing 12.

Selection members are arranged on each of said first 211 and second 212 ends for fixing each weight to said handle 21.

In particular, a first selection member 3 is fixed to said first end 211, while a second selection member 4 is fixed to said second end 212.

For simplicity of description, the description relating to the structure of said first selection member 3 is given below, since said second selection member 4 has a structure similar to the structure of the first selection member 3.

Figure 2:
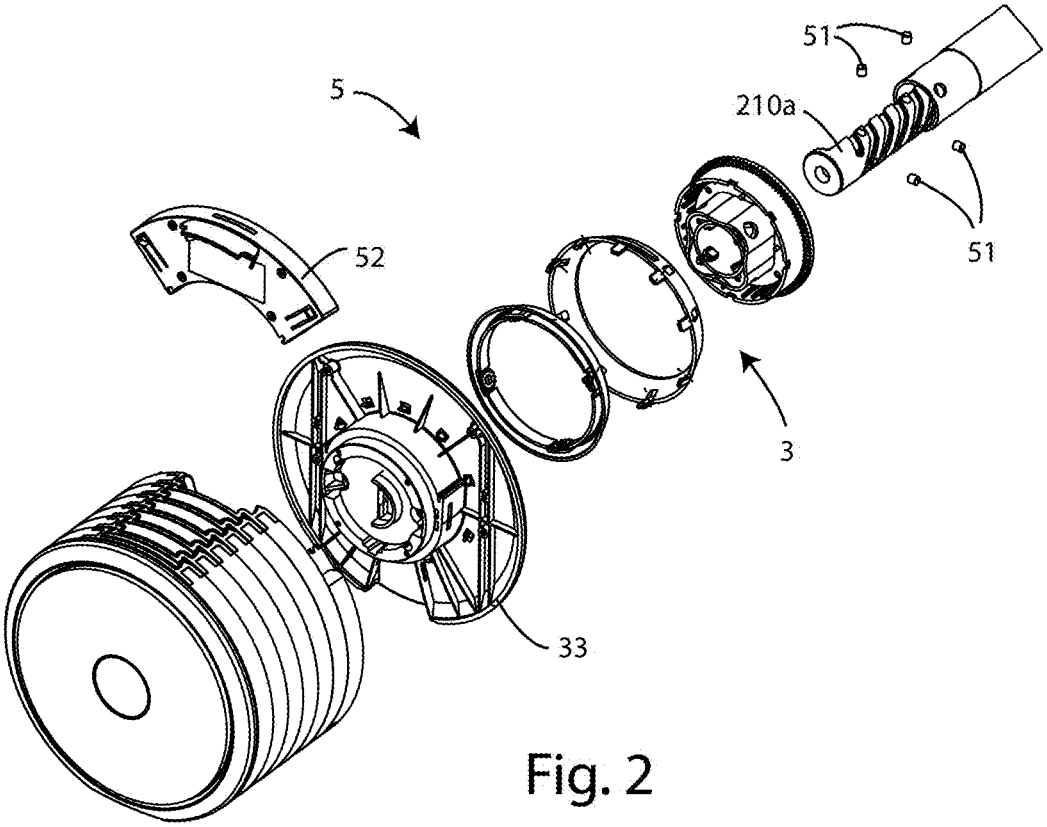
FIG. 2 shows an exploded view of a part of the system shown in FIG. 1.

With reference to FIGS. 2 and 3, said first selection member 3 comprises a hollow element 31, a numbered ring nut 32, a coupling means 33, and a cover 34 for closing said first selection member 3.

Said hollow element 31, when resting on said support frame 1, is integral with this and therefore is stationary.

Said coupling means 33 comprises inside it a first toothed circular portion, not shown in the figure, and an opening 331.

Said lid 34 is integral with said handle 21 and it is, therefore, able to rotate with it.

Said lid 34 comprises inside it a second circular toothed portion 341.

Said numbered ring nut 32 has on its surface numbers corresponding to the value of the weights selected from said first plurality of weights P1.

With reference to FIGS. 4-14, said monitoring system S comprises a device 5 for detecting the selected weight.

In particular, said detection device 5 can be arranged on said first selection member 3, by shape coupling.

The detection device 5 comprises one or more permanent magnets 51, a sensor 52, a memory unit M, a logic control unit U, and a data communication module B of wireless type, for example, Bluetooth® or Wi-Fi or NFC or Ant+ type.

In particular, said one or more magnets 51 can be in a predetermined number, in particular one magnet, or two magnets, or three magnets or, lastly, four magnets.

Predefined calibration data are stored in said memory unit M, associated with the weights that said dumbbell 2 can assume.

A first association is memorized between the data of said magnetic field and a weight of said first P1 and second P2 plurality of weights, and the association is repeated for all the weights of said first P1 and second P2 plurality of weights.

Said calibration data can be stored in the form of a look-up table.

Said data communication module B is capable of sending said data received from said logic control unit U to remote devices D, such as a smartphone, or to cloud C.

Or said detection device 5 can be arranged on said second selection member 4, by shape coupling.

Said one or more permanent magnets 51 is coupled to said first selector element 210*a*, if the detection device 5 is arranged on said first selection member 3, or to said second selector element 210*b*, if the detection device 5 is arranged on said second selection member 4.

In particular, each magnet 51 is arranged in the space between one helical groove and the next, or the previous one.

Figure 9:
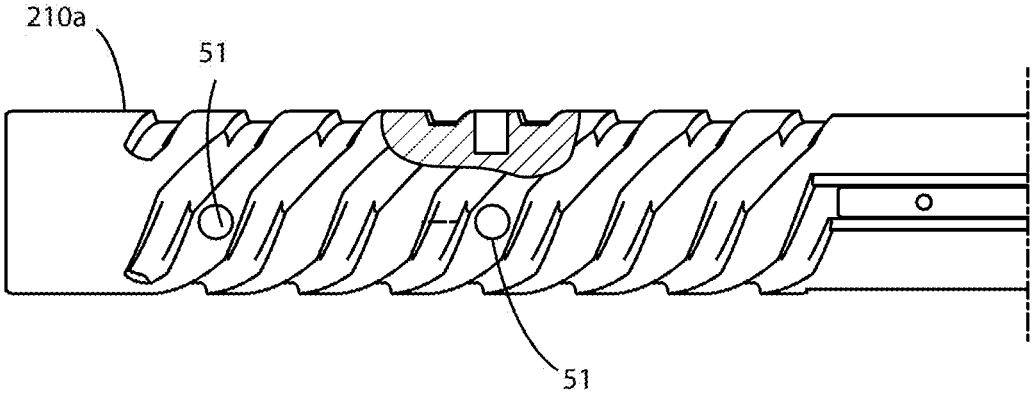
FIG. 9 shows a top view of a portion of a dumbbell component.
Figure 10:
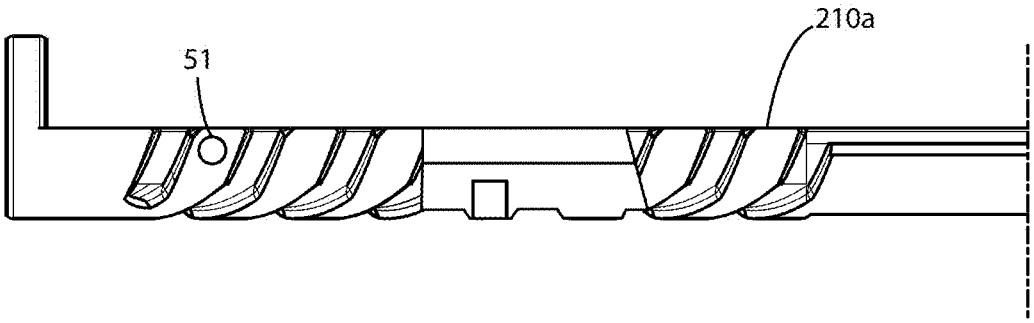
FIG. 10 shows a front view in a section of the component of FIG. 9.
Figure 11:
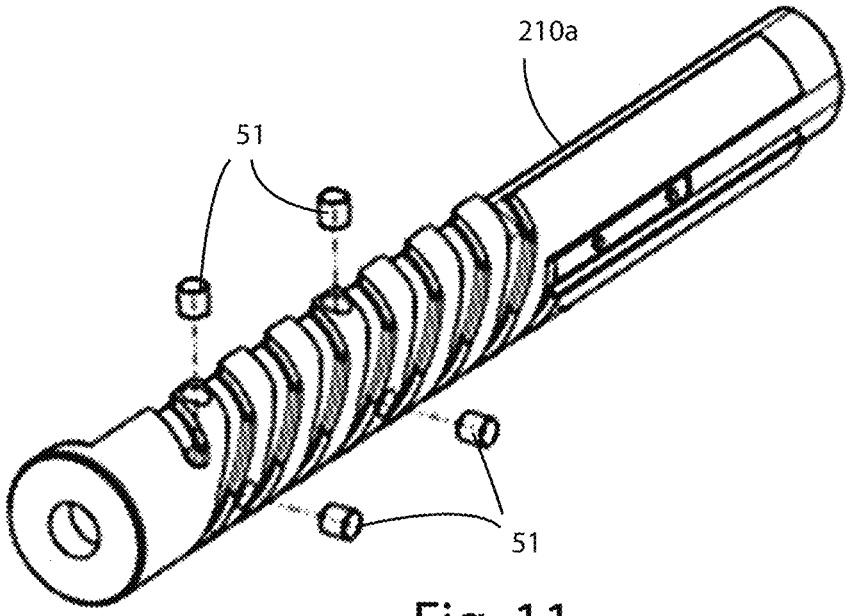
FIG. 11 shows a perspective view of the component of FIG. 9.
Figure 12:
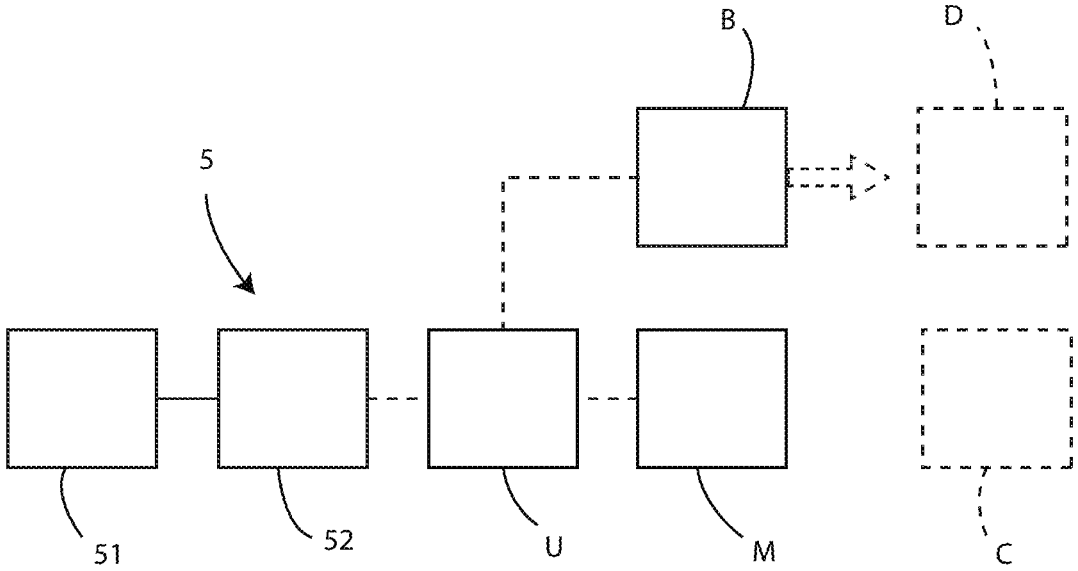
FIG. 12 shows a block diagram of the system.

In particular, with reference to FIGS. 9-11, each magnet 51 is arranged on a helical relief of said first selector element 210*a*, or of said second selector element 210*b*, or of both of said first 210*a* and second 210*b* selector element.

Each magnet 51 generates a magnetic field with known orientation.

Each magnet 51 is arranged on said first 210*a* or said second 210*b* selector element so that the magnetic field resulting from the superposition of each magnetic field has a known orientation and strength.

Sensor 52 is a magnetometer.

Said sensor 52 is capable of detecting the intensity and the orientation of the resulting magnetic field and of converting it into one or more data.

The data thus generated by said sensor 52 are sent to said control logic unit U, which processes them.

The control logic unit U is capable of comparing said received data with said calibration data, stored in the memory unit M, so as to select the value of the corresponding associated weight. The control logic unit U or controller can include one or more processors configured to execute one or more instructions stored in memory unit M to cause the system to perform the methods, processes, routines, functions, and/or algorithms discussed herein.

The control logic unit U is also capable of sending the weight value corresponding to said data communication module B.

Said data communication module B is capable of sending said weight value to remote devices D and/or to cloud units C.

Alternatively, the control logic unit U is capable of sending the raw data to said remote devices D and/or to cloud units C, which compare said data with the calibration data, to identify the corresponding associated weight value, based on a dedicated algorithm.

The operation of the system S for monitoring the weight adjustment of a dumbbell object of the present disclosure is as follows.

In an optional initial calibration step, every possible weight of said first P1 and second P2 plurality of weights is selected. For each selected weight, the data generated by the sensor 52 relating to the resulting magnetic field are sent to the control logic unit U, to be associated with the specifically selected weight, and stored in the memory unit M.

When a user wishes to perform a strength exercise using the dumbbell 2, it is initially necessary to adjust the weight of said dumbbell 2, before lifting it from the support frame 1.

The user can rotate the grip 21 in one direction, for example, the clockwise direction, to select one or more weights from said first P1 and second P2 plurality of weights, therefore to increase the weight on the dumbbell 2, or s/he can rotate the handle 21 in the opposite direction, for example counterclockwise, to decouple one or more weights from dumbbell 2, and therefore to decrease the weight on dumbbell 2.

With each rotation of the handle 21, said first 210*a* and second 210*b* selector elements extend to select or retract to release a weight of said first P1 and second P2 plurality of weights.

In particular, said first selector element 210*a* is progressively inserted into the holes of each weight of said first plurality of weights P1, while said second selector element 210*b* is progressively inserted into the holes of each weight of said second plurality of weights P2.

The weights are coupled to each other by means of a shape coupling, so that, by lifting the dumbbell 2 from said support frame 1, the weights selected by said first 210*a* and second 210*b* selector element remain integral with the dumbbell 2, while the unselected weights remain housed on said support frame 1.

In the meantime, both for said first selection member 3 and for said second selection member 4, the rotation of the handle 21, and therefore of the lid 34, causes the rotation of said numbered ring 32, therefore it will be possible to see the value of the selected weight by said opening 311.

Said first 210*a* and said second 210*b* selector element are respectively inserted into the holes of each weight of said first P1 and said second P2 plurality of weights.

Said one or more magnets 51 generates a magnetic field, which is detected by said sensor 52 and which is then converted by said sensor 52 into one or more data.

Said data are transmitted to said control logic unit U.

The control logic unit U compares said data with the calibration data, stored in the memory unit M, and selects the associated weight value corresponding to said data.

The control logic unit U then sends the corresponding weight value to said data communication module B.

Said communication module B also transmits data to remote devices D and/or cloud units C.

As evident from the above description, the monitoring system object of the present disclosure allows the detection, in a simple and reliable way, of a weight loaded or released from the dumbbell for the execution of a gymnastic exercise.

The present disclosure has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A system for monitoring adjustment of weight of a dumbbell, that can be used by a user for carrying out a gymnastic exercise, the system comprising:

a dumbbell comprising:

a hollow handle comprising a cavity, the hollow handle having an axial development along an axis of the hollow handle and configured to rotate clockwise and counterclockwise around the axis, the hollow handle comprising a first end and a second end, and the hollow handle comprising in the cavity a first selector element and a second selector element, each having a surface on which helical grooves are formed, wherein the rotation of the hollow handle causes a progressive translation of said first selector element and second selector element along the axis, a first plurality of weights, wherein each weight of the first plurality of weights is configured to be locked individually at said first end, by one of said first selector element and said second selector element, when said hollow handle rotates in a first direction, and each weight of the first plurality of weights is configured to be unlocked from said first end, when said hollow handle rotates in a second direction opposite the first direction, and a second plurality of weights, wherein each weight of the second plurality of weights is configured to be locked individually at said second end, by the other one of said first selector element and said second selector element, when said hollow handle rotates in the first direction, and each weight of the second plurality of weights is configured to be unlocked from said second end, when said hollow handle rotates in the second direction opposite the first direction, wherein the first direction is one of the clockwise and the counterclockwise and the second direction is the other one of the clockwise and the counterclockwise; and at least one detecting device comprising:

at least one magnet placed on said first selector element or said second selector element, at least one sensor configured to detect a magnetic field generated by said at least one magnet and send data corresponding to said magnetic field detected, and a controller configured to receive said data from said at least one sensor, associate said data to selected or released weight of said first and second plurality of weights, and determine a weight value based on said association.

2. The system according to claim 1, wherein the at least one magnet comprises two magnets.

3. The system according to claim 1, wherein the at least one magnet comprises three magnets.

4. The system according to claim 1, wherein the at least one magnet comprises four magnets.

5. The system according to claim 1, wherein the at least one magnet comprises a plurality of magnets.

6. The system according to claim 1, wherein said at least one sensor is arranged at said first end or at said second end of said hollow handle.

7. The system according to claim 1, further comprising a supporting frame configured to support said dumbbell.

8. The system according to claim 1, wherein the at least one detecting device further comprises a communication module configured to receive said weight value from the controller and send said weight value to remote devices or cloud units.

9. The system according to claim 1, wherein the at least one detecting device further comprises a memory unit in which predefined calibration data are stored, wherein the predefined calibration data comprise associations between selected weights of said first and second plurality of weights and resulting magnetic field data.

10. A method of using the system of claim 1, comprising following steps:

a. detecting, by said at least one sensor, data corresponding to said magnetic field generated by said at least one magnet;

b. sending said data obtained in said step a. to said controller;

c. associating, by said controller, said data to selected or released weight of said first and second plurality of weights;

d. determining, based on said association in said step c., a weight value; and e. sending said weight value determined in said step d. to remote devices and/or cloud units.

11. The method according to claim 10, further comprising following calibration steps:

f. storing a predetermined association between a weight of said first and second plurality of weights and data corresponding to a resulting magnetic field detected; and g. repeating step f. for all the weights of said first and second plurality of weights.

12. The method according to claim 11, wherein said steps f. and g. are carried out before said step c.

* * * * *